US005535554A

United States Patent [19]

Harris Jr.

[11] Patent Number: 5,535,554

[45] Date of Patent: Jul. 16, 1996

[54] GUTTER AND DRAIN SPOUT GUARD

[76] Inventor: Walter E Harris Jr., 101 May Morning Ct., Lexington, S.C. 29073-9487

[21] Appl. No.: 525,926

[22] Filed: Sep. 8, 1995

[51] Int. Cl.[6] ..... E04D 13/00

[52] U.S. Cl. ..... 52/12; 52/16; 210/474

[58] Field of Search ..... 52/12, 14, 16; 210/163, 164, 474, 477

[56] References Cited

U.S. PATENT DOCUMENTS

| | | | |
|---|---|---|---|
| 2,182,795 | 12/1939 | Day | 210/164 |
| 2,533,402 | 12/1950 | Schmitz | 52/12 X |
| 2,640,593 | 6/1953 | Korb | 52/12 X |
| 2,807,368 | 9/1957 | Blau | 52/12 X |
| 3,409,138 | 11/1968 | Lawrence | 52/12 X |
| 3,713,539 | 1/1973 | Thompson et al. | 210/164 |
| 4,112,691 | 9/1978 | Ebeling et al. | 52/12 X |
| 4,216,790 | 8/1980 | Stoltz | 210/163 X |
| 4,230,346 | 10/1980 | Gobel | 210/474 X |
| 4,615,153 | 10/1986 | Carey | 52/16 X |
| 4,798,028 | 1/1989 | Pinion | 52/16 |
| 5,107,635 | 4/1992 | Carpenter | 52/16 X |
| 5,302,283 | 4/1994 | Meuche | 210/474 X |
| 5,397,464 | 3/1995 | Hannon | 210/163 |
| 5,452,546 | 9/1995 | Goddard | 52/12 |

FOREIGN PATENT DOCUMENTS

| | | | |
|---|---|---|---|
| 3703320 | 11/1988 | Germany | 52/12 |
| 6117065 | 4/1994 | Japan | 52/12 |
| 6716785 | 6/1969 | Netherlands | 52/12 |

*Primary Examiner*—Lanna Mai
*Attorney, Agent, or Firm*—Michael A. Mann

[57] ABSTRACT

A gutter and drain spout guard for preventing debris from the roof of a house from clogging the gutter and drain spout. The guard includes a base, two end walls and a cap. The base is generally rectangular in shape, with the two end walls extending perpendicularly from its ends. The base is positioned within a gutter over the drain spout. The cap is positioned over the opening of the drain spout and is connected to the base through a loop. The loop also extends into the drain spout, biased against the walls of the drain spout, thus securely positioning the guard with respect to the drain spout. The end walls of the guard prevent debris from collecting near the drain spout opening. Once the debris has reached the height of the end walls, the debris flows closer to the opening. However, the cap prevents the debris from collecting directly in the drain spout. The cap also prevents debris, falling directly from the roof, from collecting over the opening. The base, end walls, and cap are constructed from a wire or plastic mesh and allow water and small particles to flow into the drain spout. Therefore, the base, end walls, and cap prevent debris that could clog the drain spout from collecting near the opening, thus allowing the water to continually flow within the gutter and drain spout.

18 Claims, 1 Drawing Sheet

26
18
22
12
18
40
10
32
22
50
30
42
20
52
34
14
16

10
40
32
30
50
42
12
30
34
52
14

18
26
22
40
50
10
42
32
34
18
16
30
14
60

26
22
10
12
14
16

GUTTER AND DRAIN SPOUT GUARD

BACKGROUND OF THE INVENTION

1. Field of the Invention

The present invention relates to gutter and drain spout guards, and more specifically, to a mesh device to prevent the clogging of gutters and drain spouts due to leaves, pine straw and other debris.

2. Discussion of Background

The roofs of homes and other buildings typically have gutters surrounding the exterior of the building to catch and then redirect rain water flowing down the roof. Gutters are generally shaped as a channel with a flat floor and two opposing side walls. The gutters redirect the flow of water into a drain spout which then carries the water to the ground.

A gutter and drain spout prevent water from flowing off a roof to the ground, which creates a gully around the perimeter of a house. Over a period of time, the continuous force and erosion of the ground from the water off of the roof will begin to eat away at the foundation of the house. Therefore, gutters can be a very cost efficient means of protecting the foundation of a house.

A problem with the gutters and drain spouts occurs when the gutters or drain spouts become clogged. Leaves, pine straw and other debris collect on the roofs of houses. When water flows down the roof, the debris is carried into the gutters and drain spouts, clogging both. If the gutter or drain spout is clogged, the water is not transported to ground through the drain spout, but will flow over the side walls of the gutter, thus rendering the gutter system ineffective.

There are various devices to prevent the clogging of the gutter and drain spout. Specifically, there are several patents that disclose cage-like structures positioned over or within the drain spout to prevent it from clogging. See, for example, U.S. Pat. No. 316,578 issued to Schumann, U.S. Pat. No. 1,937,732 issued to Tverdak, U.S. Pat. No. 2,640,593 issued to Korb, and U.S. Pat. No. 2,807,368 issued to Blau. Furthermore, there are references that merely prevent debris from reaching the drain spout. See, for example, U.S. Pat. No. 571,711 issued to Twist, and U.S. Pat. No. 2,669,197 issued to Duzer. However, there still remains the need for a device that is lightweight, easy to install, low cost, and that both prevents debris from entering the drain spout and from reaching the drain spout.

SUMMARY OF THE INVENTION

According to its major aspects and broadly stated, the present invention is a guard to prevent the clogging of a gutter and drain spout. The guard comprises a wire or plastic mesh base having a first and second end. The mesh base is dimensioned to fit within a gutter and can be dimensioned to fit into different sized gutters. Also, the mesh base can be sized to fit within gutters having corners or turns. The mesh base rests along the floor of the channel of the gutter and has two end walls extending perpendicularly from the first and second end, respectively. The end walls are approximately 1½ inches high and prevent debris from flowing towards the drain spout, while permitting fluid and relatively small particles to continue to flow.

A cap, dimensioned as a rectangular box, is positioned over the drain spout on top of the mesh base. The cap is removably attachable to the mesh base by a loop. The loop not only secures the cap to the mesh base, but extends into the drain spout. The loop is designed to be biased against the walls of the drain spout, thus securely positioning the cap and the mesh base over the drain spout. The loop can be constructed from wire or any other suitable material, so that the loop will act as a spring inside the drain spout.

The mesh base with its two end walls prevents relatively large debris from flowing into the drain spout, where it could possibly clog. If debris fills up the channel of the gutter enough so that it is higher than the end walls, the debris will flow over the end wall. However, the cap positioned over the drain spout will prevent the debris from entering the drain spout. The cap also prevents debris that falls from the roof directly over the mesh and the drain spout from entering or blocking the entrance of the drain spout.

Relatively small debris and other small particles, such as sand, that will not clog the drain spout, are allowed to pass through the mesh base, the end walls and the cap, thus flowing into the drain spout. These particles not only flow through the mesh, but also around the mesh, especially if the mesh is not dimensioned exactly as the floor of the gutter.

If the gutter has a corner, the drain spout typically extends from the corner to the ground. In this situation, an L-shaped mesh extends on both sides of the corner with two end walls extending from their respective ends. The cap is still positioned above the drain spout and secured to the mesh base by the loop. The loop extends into the drain spout and secures the mesh base and cap in position, as described above.

An important feature of the present invention is the two end walls connected by a mesh base. The end walls allow fluid to pass to the drain spout, but prevent debris from collecting within the drain spout or even relatively near the drain spout. Preventing the debris from entering the drain spout reduces the number and frequency of clogs that occur within the drain spout. The height of the end walls allows debris to flow over the end walls only when there is enough debris to reach that height, thus preventing the debris and water from flowing over the sides of the gutter.

Another important feature of the present invention is the cap. The cap is positioned over the drain spout, thus preventing debris from falling directly into the drain spout. Furthermore, the cap prevents debris that has flowed over the end walls to enter the drain spout, thus preventing the clogging of the drain spout or its entrance.

Yet another important feature of the present invention is the detachable cap. This allows the guard to be easily assembled and disassembled. The guard can be removed easily from the gutter, thus permitting the cleaning of debris that has collected near the end walls without having to clean the drain spout.

Still another feature of the present invention is the loop extending into the drain spout. The loop enables the guard, including the base and cap, to be positioned securely over the drain spout, thus assuring correct alignment.

Another feature of the present invention is the fluid permeability of the mesh base and cap. Fluid and relatively small particles are permitted to pass through the base and cap, thus draining out through the drain spout. The particles that are allowed to pass into the drain spout are small enough so that there is no possibility that the drain spout will be clogged.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
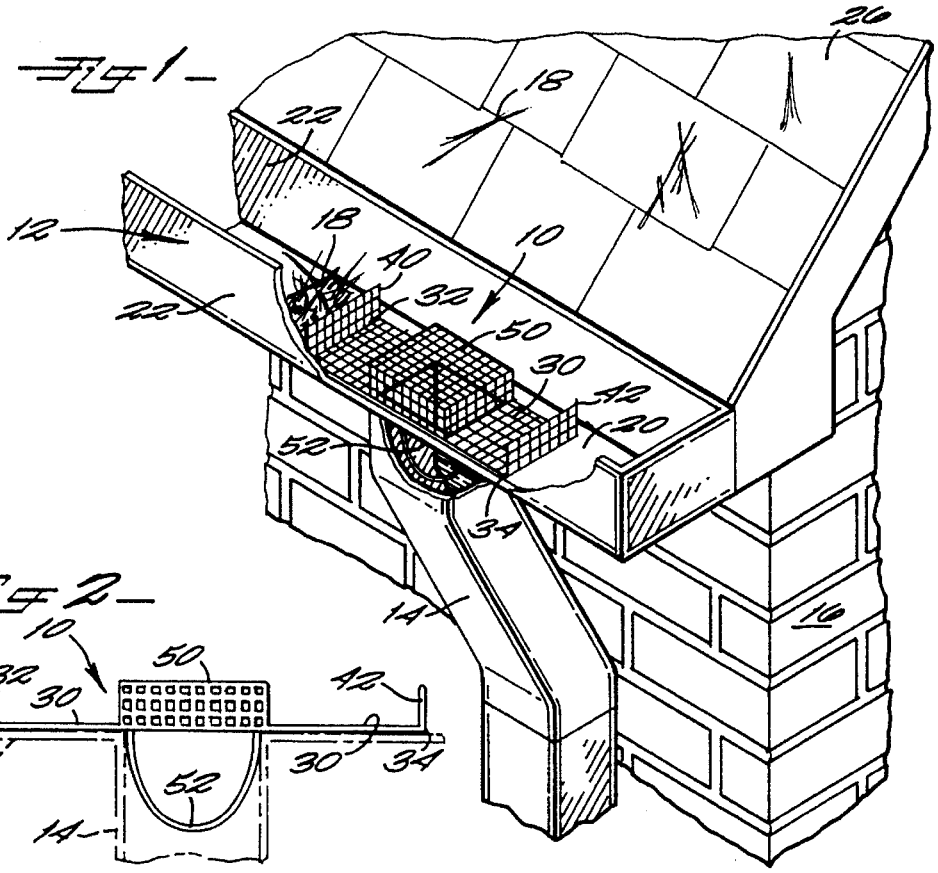
FIG. 1 is a perspective view of a gutter and drain spout guard according to a preferred embodiment of the present invention.

In the following description, similar components are referred to by the same reference numeral in order to simplify the understanding of the sequential aspect of the drawings.

Figure 2:
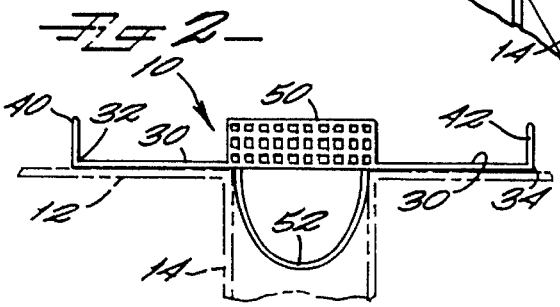
FIG. 2 is a front view of a guard with a gutter and drain spout shown in phantom lines for clarity, according to a preferred embodiment of the present invention.
Figure 3:
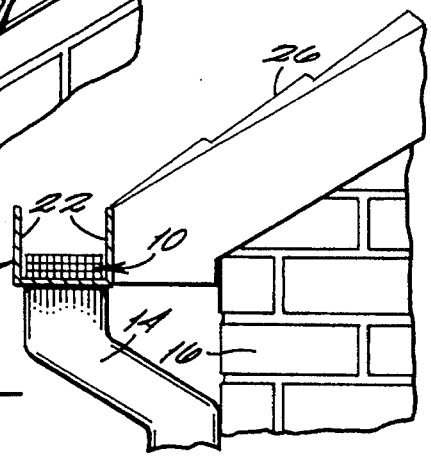
FIG. 3 is a side view of a gutter and drain spout guard according to a preferred embodiment of the present invention.

Referring now to FIGS. 1, 2, and 3, there is shown a gutter and drain spout guard 10 according to a preferred embodiment of the present invention. Gutter and drain guard (hereinafter guard) 10 comprises a base 30, a first end wall 40, a second end wall 42, and a cap 50. A gutter 12 is generally attached to a house 16 or other building to channel the flow of water from a roof 26 of house 16 through gutter 12 to a drain spout 14. Gutter 12 includes a floor 20 and two opposing side walls 22 that typically extend perpendicular to floor 20. Drain spout 14 transports the water from the gutter 12 to the ground, thus preventing the water from directly flowing from roof 26 to the ground.

Water that flows directly from roof 26 to the ground erodes the soil around the foundation of house 16, which subsequently causes damage to the foundation. Gutter 12 redirects the flow of water from roof 26 through gutter 12 and drain spout 14 to the ground. However, when gutter 12 or drain spout 14 clog, the water is not able to flow to the ground through gutter 12 and will flow over side walls 22 to the ground. This will also cause the soil to erode and cause damage to the foundation. Therefore, it is necessary to prevent gutter 12 and drain spout 14 from becoming clogged.

Guard 10 is used to prevent debris 18, including leaves, pine straw and sticks from clogging gutter 12 or drain spout 14, which would otherwise disrupt the flow of water within gutter 12. Base 30 is constructed in a generally rectangular shape having a first end 32 and a second end 34. Extending approximately perpendicular to base 30 from first end 32 is first end wall 40. Extending approximately perpendicular to base 30 from second end 34 is second end wall 42. First and second end walls 40 and 42 extend a height that is less than the height of opposing side walls 22 of gutter 12. In a preferred embodiment, both first end wall 40 and second end wall 42 extend from first end 32 and second end 34, respectively, approximately 1½ inches.

Cap 50 is generally a rectangular box having a height equal to approximately the height of first and second end walls 40 and 42. Cap 50 is positioned so that it is over the opening of drain spout 14. A loop 52 connects to cap 50 so that cap 50 attaches to base 30. Loop 52 also functions to locate both base 30 and cap 50 over drain spout 14. Loop 52 extends into drain spout 14 so that loop 52 is biased against the interior walls of drain spout 14, thus securing base 30 and cap 50 over drain spout 14. Loop 52 is preferably constructed from a wire, but could be any material that has sufficient resilience to function as a spring element to secure cap 50 and base 30 to drain spout 14.

Cap 50, base 30, first end wall 40, and second end wall 42 are constructed from a mesh material. This material can be metal or plastic, or any other suitable, preferably non-corrosive material. The mesh comprises a series of holes and is dimensioned so that debris 18 that is permitted to pass through the holes does not clog gutter 12 or drain spout 14. Therefore, guard 10 does not stop all of debris 18 from flowing into drain spout 14, but only debris 18 that is large enough to be blocked by the mesh material of base 30 and cap 50. However, it is debris 18 of this relatively large size that tends to block drain spout 14.

Base 30 is preferably dimensioned to fit within two opposing side walls 22 and rest on floor 20. Base 30 extends to cover substantially the portion of floor 20 between two opposing side walls 22. There should be less than approximately ⅜ of an inch gap between base 30 and two opposing side walls 22. The size of the gap and height of first and second end walls 40 and 42 allow objects and debris 18 that are small enough, to pass through the gap around first and second end walls 40 and 42 and down drain spout 14. However, the size of the gap and the height of first or second end wall 40 and 42 prevent the larger objects and debris 18 from entering drain spout 14, where it may become clogged.

Once debris 18 behind end walls 40 and 42 is at a height sufficient to pass over end walls 40 and 42, cap 50 prevents debris 18 from congregating directly over the opening of drain spout 14, thus maintaining the opening of drain spout 14 free and clear, so that water will still readily flow to the ground. Furthermore, cap 50 prevents debris that falls directly onto cap 50 and base 30 from clogging the opening of drain spout 14.

Guard 10 not only prevents the clogging of drain spout 14, but delays the time at which the home owner needs to clean out gutter 12. Guard 10, comprising end walls 40 and 42, base 30, and cap 50, prevents drain spout 14 from clogging until debris 18 collects in a sufficient amount to completely cover guard 10. Once debris 18 reaches this amount, water flowing through gutter 12 is restricted from flowing down drain spout 14. Therefore, the home owner will recognize that gutter 12 needs to be cleaned, while eliminating the necessity of cleaning drain spout 14.

Figure 4:
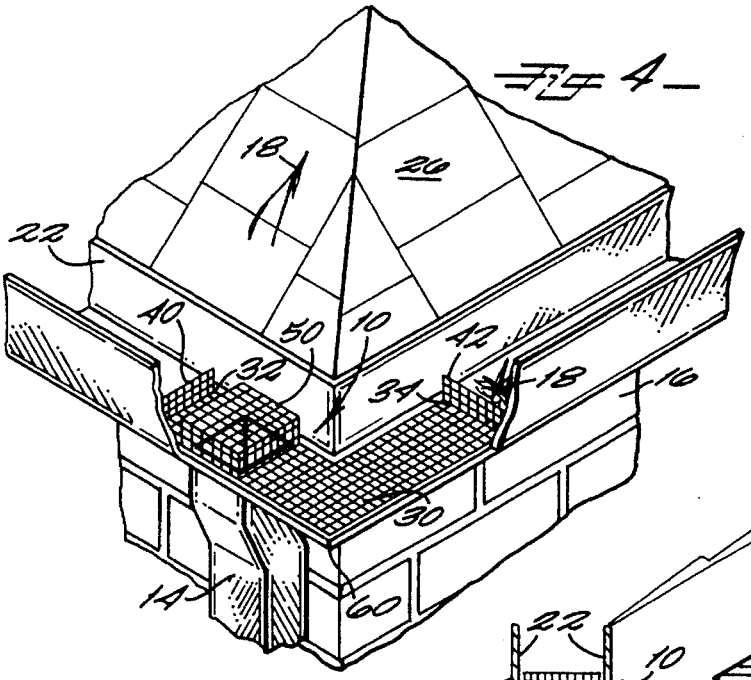
FIG. 4 is a perspective view of a gutter and drain spout guard within a gutter extending around a corner of a house, according to an alternative embodiment of the present invention.

In a preferred embodiment of the present invention, guard 10 is designed to fit within a straight stretch of gutter 12, with cap 50 centered over drain spout 14, as in FIGS. 1, 2, and 3. In an alternative embodiment of the present invention, gutter 12 extends around a corner 60 of house 16. Guard 10 is designed with the corresponding angle of corner 60, so that guard 10 extends on both sides of corner 60. Therefore, guard 10 in an alternative embodiment has an approximate L-shape to conform to a 90° corner within gutter 12. See especially FIG. 4. Drain spout 14 can be positioned on either side of corner 60, or possibly follow corner 60. In either case, cap 50 is positioned over drain spout 14 and attached to base 30. Furthermore, loop 52 extends into drain spout 14, securing cap 50 and base 30 to gutter 12 and drain spout 14.

In operation base 30 and cap 50 are positioned together within gutter 12, so that cap 50 is over drain spout 14. Loop 52 is positioned inside drain spout 14 so that base 30 and cap 50 are secured to drain spout 14. Once debris 18 collects within gutter 14 such that water flow in gutter 12 is restricted, the home owner may remove guard 10 from its position and easily clean gutter 12, without having to clean drain spout 14. Once gutter 12 is clean, guard 10 can be replaced until the next cleaning.

It should be noted that gutter 12, specifically floor 20 between two opposing side walls 22, may range in size.

Guard 10 can be dimensioned so that it is operable in these different size gutters, as described above. Furthermore, drain spout 14 may vary in size as much as 2 or 3 inches at the point it intersects gutter 12. Consequently, loop 52 may have to be moved inward on cap 50 and base 30 in order to center cap 50 over drain spout 14, when drain spout 14 is narrower than cap 50. These dimension changes are anticipated by the inventor and therefore are within the scope of this disclosure.

It will be apparent to those skilled in the art that many changes and substitutions can be made to the preferred embodiment herein described without departing from the spirit and scope of the present invention as defined by the appended claims.

What is claimed is:

1. An apparatus for preventing debris from clogging drain spout, said drain spout descending from a gutter, said apparatus comprising:

a first water permeable means for preventing said debris from entering said drain spout;

a second water permeable means for delaying said debris from clogging said first water permeable means;

a third water permeable means for preventing said debris from clogging said first water permeable means, said third water permeable means positioned over said drain spout; and means for securing said first water permeable means and said second water permeable means to said drain spout.

2. The apparatus as recited in claim 1, wherein said first water permeable means is constructed from a mesh.

3. The apparatus as recited in claim 1, wherein said second water permeable means is constructed from a mesh.

4. The apparatus as recited in claim 1, wherein said second water permeable means comprises two end walls extending approximately perpendicularly from said first water permeable means.

5. The apparatus as recited in claim 1, wherein said gutter has two opposing side walls having a height, said second water permeable means comprising two end walls extending approximately perpendicularly from said first water permeable means, said end walls extending to a height less than said height of said two opposing side walls.

6. The apparatus as recited in claim 1, wherein said first water permeable means and said second water permeable means are constructed from a mesh, so that said first water permeable means and said second water permeable means are impermeable to said debris.

7. An apparatus for preventing debris from clogging drain spout, said drain spout descending from a gutter, said apparatus comprising:

a first water permeable means for preventing said debris from entering said drain spout;

a second water permeable means for delaying said debris from reaching said first water permeable means;

means for spacing said second water permeable means from said first permeable means, wherein said spacing means comprises a mesh base; and means for securing said first water permeable means and said second water permeable means to said drain spout.

8. The apparatus as recited in claim 7, wherein said first water permeable means comprises a detachable cap.

9. The apparatus as recited in claim 7, wherein said second water permeable means comprises a first end wall and a second end wall.

10. The apparatus as recited in claim 7, wherein said spacing means has a first end and a second end, said second water permeable means comprising a first end wall extending approximately perpendicularly from said first end of said spacing means and a second end wall extending approximately perpendicularly from said second end of said spacing means.

11. The apparatus as recited in claim 7, wherein said gutter has two opposing side walls having a height, said second water permeable means comprising two end walls extending approximately perpendicularly from said first water permeable means, said end walls extending to a height less than said height of said two opposing side walls.

12. The apparatus as recited in claim 7, wherein said first water permeable means and said second water permeable means are constructed from a mesh, so that said first water permeable means and said second water permeable means are impermeable to said debris.

13. The apparatus as recited in claim 7, wherein said securing means further comprises at least one loop extending from said first water permeable means into said drain spout.

14. An apparatus for preventing the clogging of a gutter and a drain sprout, said gutter having a channel intersected by said drain spout, so that said gutter and said drain spout are in fluid communication, said apparatus comprising;

a water permeable base having a first end and a second end;

a first end wall extending approximately perpendicularly from said first end of said base;

a second end wall extending approximately perpendicularly from said second end of said base;

a fluid permeable cap, said cap removably attachable to said base, said cap located between said first end wall and said second end wall; and means for positioning said cap over said drain spout.

15. The apparatus as recited in claim 14, wherein said positioning means further comprises at least one loop extending from said cap into said drain spout.

16. The apparatus as recited in claim 14, wherein said channel has a corner and said drain spout intersects said channel proximate to said corner, said base extending in an approximate L-shape within said channel so that said base conforms to said corner of said channel.

17. The apparatus as recited in claim 14, wherein said first end wall and said second end wall extend approximately 1½ inches from said base.

18. The apparatus as recited in claim 14, wherein said base and said cap are constructed from a material selected from the group consisting of wire mesh and plastic mesh.

* * * * *